US005251791A

United States Patent [19]

van Leer

[11] Patent Number: 5,251,791

[45] Date of Patent: Oct. 12, 1993

[54] CHILD-PROOF CLOSURE FOR A BOTTLE OR SIMILAR CONTAINER

[75] Inventor: Oscar J. van Leer, Eemnes, Netherlands

[73] Assignee: Docor B.V., Eemnes, Netherlands

[21] Appl. No.: 659,289

[22] PCT Filed: Nov. 28, 1989

[86] PCT No.: PCT/NL89/00090

§ 371 Date: Mar. 26, 1991

§ 102(e) Date: Mar. 26, 1991

[87] PCT Pub. No.: WO90/06270

PCT Pub. Date: Jun. 14, 1990

[30] Foreign Application Priority Data

Nov. 29, 1988 [NL] Netherlands ..... 8802942

[51] Int. Cl.[5] ..... B65D 55/12

[52] U.S. Cl. ..... 222/153; 222/522; 220/319

[58] Field of Search ..... 222/153, 522, 523, 568-570; 220/319

[56] References Cited

U.S. PATENT DOCUMENTS

| | | | |
|---|---|---|---|
| 1,796,785 | 3/1931 | Harding | 222/522 |
| 2,165,825 | 7/1939 | Von Bultzingslowen | 222/522 X |
| 2,877,918 | 3/1959 | Gardner | 222/498 X |
| 3,305,145 | 2/1967 | Tebbutt | 222/522 |
| 3,915,359 | 10/1975 | Feldman | 222/514 |
| 4,162,749 | 7/1979 | Bennett | 222/522 X |
| 5,016,787 | 5/1991 | Beck | 222/522 |

FOREIGN PATENT DOCUMENTS

| | | |
|---|---|---|
| 2217234 | 9/1974 | France . |
| 2034674 | 6/1980 | United Kingdom . |
| 2035279 | 6/1980 | United Kingdom . |
| 2105693 | 3/1983 | United Kingdom . |

*Primary Examiner*—Kevin P. Shaver
*Attorney, Agent, or Firm*—Young & Thompson

[57] ABSTRACT

Child-proof closure for a bottle (1) which is placed upon the neck of the bottle to replace its normal closure and which is axially slidable from a closed position towards an open position and back. The closure has locks (13,24) at the inner end of a quiver-like part (12) which can only be reached by the stretched or bent finger of an adult person and can be closed by a simple flick on top of the opened closure.

1 Claim, 5 Drawing Sheets

CHILD-PROOF CLOSURE FOR A BOTTLE OR SIMILAR CONTAINER

FIELD OF THE INVENTION

The invention relates to a child-proof closure for a bottle or similar container which is provided with a neck having an external screw thread or comparable locking devices, such as a bayonet closure, for a detachable closure cap, as well as, with a radially projecting edge situated beneath the screw thread or the like, which edge can interact with a ring which grips under the edge and is joined to the closure cap by means of break strips and which can also interact with a resilient locking device which acts under said edge and which forms part of the child-proof closure.

BACKGROUND OF THE INVENTION

A child-proof closure of this type is known from the GB-A-2 035 279. This known closure involves a housing which can be placed over a screw cap and which is provided with a locking device which, when at rest; grips under the edge of the screw cap or under the projecting edge of the neck of the bottle, which housing is freely rotatable on the neck in this state. The housing of this closure is provided with a quiver-like part which offers room to a finger of the hand and which is provided at the bottom with an actuating device for the lock, with the aid of which the lock can be moved against spring force and can be brought to the unlocked state. Said locking device is located at a distance from the opening of the quiver-like part which is larger than the average length of the longest finger of a child of a predeterminable age and can therefore be reached only by a finger having a predeterminable minimum length, such as a finger of the hand of an adult. Children of the abovementioned age or younger are therefore unable to unlock the closure. The correct distance or length can be determined on the basis of statistical data on the sizes of the people in the field of application.

If it is desired to use the contents of a bottle protected in this manner, the housing of the closure has to be removed, after which the screw cap is accessible and can be screwed off in the normal manner. This may be a screw cap which is protected by means of a break strip. However, after being opened once, this last type behaves like a normal screw cap. If the closure is placed on the screw cap, the latter is freely rotatable therein, with the result that it is not possible to unscrew the screw cap with the aid of the housing of this closure.

This known child-proof closure is not always safe. The person who has taken some of the contents of the bottle in order to make it inaccessible again for children, may be interrupted in doing so and there is then a danger that said person does not bring about the restoration of the closure again in due time because, to do this, it is first necessary to find and place the screw cap and then to find and place the housing with the lock.

The object of the invention is to provide a child-proof closure which lacks the drawbacks of the known closure, which can if necessary be brought into the protected closed state with one flick of the hand and which, in addition, can be completely sealed for transportation purposes even after any opening and pouring out, without replacing any component such as the closure cap with retainer ring and break strips. In addition, the object of the invention is a child-proof closure which, after the contents of a bottle have been poured out, can be transferred to a subsequent bottle.

SUMMARY OF THE INVENTION

According to the invention, this object can be achieved in the first place in that the child-proof closure has a section which is provided with an internal screw thread and which can be placed on the part of the neck provided with a screw thread or the like instead of the closure cap, as well as with a tubular extension above said section which is in line with the neck, which extension has an outlet opening and on which a sliding valve is placed in an axially slidable manner and has an outlet opening, which sliding valve brings the outlet opening of the tubular extension and of the valve into interaction with each other in the pushed-out position and closes the outlet opening of the tubular extension in the other, pushed-in closure position, in which closed position the sliding valve is locked with the locking device which interacts with the radially projecting edge of the neck, which locking device is provided with actuating means of shape and sizes such that it is accessible only for a finger or the fingers having predeterminable sizes. That is to say, a finger which is longer than the longest finger of a child of predeterminable age, for example the age of 8 years.

Whereas the actuation of the lock served only to detach the housing in order to make the normal screw cap accessible in the case of the known closure, to cause the closure according to the invention to function, the normal screw cap is replaced by the tubular extension, on which tubular extension there is a displaceable tube or sliding valve which frees the pouring opening in the pushed-out position and which is locked in the pushed-in position and therefore does not have to be removed from the bottle. Therefore, if a mishap occurs while a bottle provided with said closure according to the invention is being handled, the bottle has only to be set down and the sliding valve has to be given a sufficiently strong flick, as a result of which the closure reaches and maintains the child-proof position and can be opened again only by the adult.

The outlet opening of the tubular extension may be formed by a window in the wall of said extension, which window interacts with a window of the sliding valve.

However, an embodiment is preferred in which the end of the tubular extension is the outlet opening thereof. This is because the circular end of a tube makes possible a better closure than in the case of an embodiment having windows only.

Constructionally, the main principle underlying the invention can be achieved in various ways.

An embodiment is preferred in which the locking device is situated in a housing of the child-proof closure, which housing has a quiver-like part open only at one end, which part offers room for only one finger of the hand of an adult person and has, in the lower section, an actuating device for the locking device, which actuating device is situated at a predeterminable distance from the opening of said quiver-like part which is characterized, according to the invention, in that the sliding valve forms a single entity with the quiver-like part.

The opening at the end of the quiver-like part may be situated in a plane which is perpendicular to the center line of the tubular extension, in which case the finger is therefore inserted into the quiver-like part in a direction which is parallel to the center line of the said extension and therefore also parallel to the center line of the neck of the bottle. The finger inserted is then stretched.

In order to make any unintentional operation with any object or other, such as a pencil, impossible it is also possible, according to the invention, that the opening in the part of the housing intended for inserting the finger of the hand in order to be able to reach the actuating device of the locking device is situated in a plane which makes an angle with the center line of the tubular extension, which angle is less than 90 degrees, and this opening is situated at a distance from the actuating device such that the said finger can reach or actuate said actuating device only when bent.

Preferably the opening is situated in the side surface of the housing in a plane which runs parallel to the center line of the tubular extension.

The predeterminable distance must be greater than the average length of the longest finger of a child of a predeterminable age and said distance must in fact be such that an adult does not have any difficulty in reaching the locking device. It is therefore furthermore preferable that only one locking device is present and said housing is freely rotatable on the tubular extension in the closed position, the locking device engaging in the space which is situated directly beneath the projecting edge of the neck. Said embodiment has the advantage of having only one lock which can be reached only by an adult in the closed position, in which closed position the unscrewing of the tubular extension placed on the neck of the bottle is ruled out because the housing with the sliding valve is freely rotatable.

In this embodiment it is preferable that the tubular extension is provided near the lower edge with an external helix which is able to interact with an internal screw thread in the lower section of the sliding valve, with the aid of which the housing with the sliding valve can be pulled on axially towards the container until the top end of the tubular extension forms a seal against the end closure of the sliding valve. This provision makes it possible to screw on the sliding valve downwards in the child-proof locked position in a manner such that a seal is ensured against the circular debouchment of the tubular extension. In the screwed-on position, the closure is always leakproof.

It may be preferable to provide the helix with a stop so that it is not screwed on too far when the sliding valve is screwed on.

When the sliding valve is being screwed on, it moves axially downwards and since the sliding valve forms a single entity with the quiver-like part of the housing containing the locking device, the latter is also displaced axially. According to the invention, it is now preferable that the neck of the holder has, at a distance below the projecting edge, a bevelled edge which runs downwards and circumferentially and which interacts with a bevelled edge of the locking device. This bevelled edge ensures that the screwing-on is not impeded by the lock and also provides for a displacement of the lock.

Beneficial use can be made of this in that the lock has a pin which is directed away from the neck and which interacts with a window in the outside wall of the wall section of the quiver-like part in a manner such that, in the pulled-on closed position of the sliding valve, said pin is visible in the window. If the pin, which may be provided with a colour, appears in the window, the user knows that the absolutely sealed position which is safe for transportation has been reached. In addition, the user can see from this that he has first to unscrew the closure before opening the closure until the lock again engages in the space below the projecting edge, after which the housing with the sliding valve can be pushed upwards into the open position by actuating the lock.

It is also possible to achieve the visualization of the leakproof closed position in another way.

During the axial screwing-on, the window of the sliding valve is axially displaced with respect to the tubular extension and the latter may have a coloured area, for example, a green area, which becomes visible in the window in the screwed-on position.

According to the invention, it is further possible, in this embodiment, that, near the top end, the tubular extension has circumferentially spaced apart locking ribs which extend axially and which can interact with ribs on the internal surface of the sliding valve which engage between them. As a result of these mutually engaging ribs, which mutually engage only when the sliding valve is in the pushed-out, and therefore open, position, it is possible to screw off the entire child-proof closure of the bottle. Since only an adult is capable of bringing the sliding valve into the open position, there is no danger that a child could remove the entire closure by screwing. After all, in the closed position, the housing with sliding valve and quiver-like part is freely rotatable, unlocking by the child not being possible.

In order to obtain a still greater safety in this freely rotatable position, according to the invention the tubular extension screwed onto the neck has teeth at the lower edge which act on the upper surface or engage in matching teeth of the projecting edge present at that point. This achieves the result that on screwing on and tightening up, such a friction is obtained between the lower edge of the tubular extension and the upper surface of the projecting edge that a relatively large force is required to start unscrewing.

Additional safety can furthermore be built in if, according to the invention, the lock consists of a clasp which is tiltably and displaceably mounted in the quiver-like part and is provided with a locking cam which interacts with a locking edge of the housing in a manner such that displacement from the locking position in a direction away from the neck is possible only after tilting the clasp. This tilting possibility limits the danger that a child pokes the quiver-like part with, for example, a pencil and tries to displace the lock. The tilting movement can, after all, not be carried out easily with a pencil but it can with a finger. The lock itself is unlocked by the tilting. In this connection it may be beneficial that the section of the lock which may come into contact with a finger is of a smooth and sloping construction that, although the finger can press on it, any thin object such as a pencil glances off from it.

This unlocking of the lock by tilting is not necessary in the embodiment in which the opening for inserting the finger is situated on the side of the housing.

In addition, the quiver-like part may have, just above the clasp, a guard which makes only the inwardly facing actuating surface of the clasp accessible, and also an edge which protects the locking cam in the upward direction. No single part of the clasp with the locking cam is consequently accessible to any tool and only the sloping and smooth actuating surface is accessible for the tip of the finger.

According to a further embodiment of the child-proof closure according to the invention, it can be characterized in that the housing with the quiver-like part is fitted by means of an annular part on the internal part, provided with a screw thread, of the tubular extension and is axially retained, on the one hand, by a flange on the lower edge of the tubular extension against which the annular part rests and, on the other hand, by a first resilient locking device which forms part of the annular part and can engage under the projecting edge of the neck, the actuating device of said first locking device being situated below the quiver-like part and the sliding valve being axially movable independently of the quiver-like part and interacting in the closed position with a second elastic locking device which acts on the sliding valve and whose actuating device is also situated at the bottom of the quiver-like part at the same distance from the opening as the actuating device of the first locking device.

In this embodiment, the housing of the quiver-like part and the sliding valve are two separate parts and these therefore each have their own lock whose actuating device is situated at the same position at the bottom of the quiver-like part.

This embodiment may also be provided with a tubular extension having an external helix at a point situated below the point where the second elastic locking device interacts with a flange on the sliding valve and this has in the lower section an internal screw thread which can interact with the external screw thread of the tubular extension after the sliding valve has passed the lock during closure, which sliding valve is then pressed with its closed top end onto the upper edge of the tubular extension by interaction of said screw threads. Said helix also serves to bring about a tight closure by screwing on after the sliding valve is pressed into the child-proof locked position. In this embodiment, specific provisions are necessary for screwing the closure onto the neck of the bottle or removing it therefrom. Said means could consist of mutually engaging ribs of the tubular extension and the sliding valve when the latter is in the pushed-out position, in which case, however, the sliding valve then has to be further provided with a surface on which, if necessary, a tool can act in order to make tightening up or unscrewing possible.

In the embodiment described earlier, this is not necessary because housing and sliding valve form a single entity and during screwing on or unscrewing a large leverage is present which is obtained by the housing.

According to a third embodiment of the child-proof closure according to the invention, it may be characterized in that the locking device consists of an elastically deformable ring which can engage by means of two parts situated opposite each other below the radially projecting edge of the neck and has, at two other positions situated opposite each other, actuating parts which are situated in outwardly protected spaces of the housing of the sliding valve, which spaces have an opening, which openings are situated at a distance from each other such that the two actuating parts in the spaces are simultaneously accessible only by two fingers which are of predetermined size of one hand.

In this embodiment, immediate closure is also possible by striking the opened sliding valve. For opening, the ring has to be deformed with two fingers of one hand (since the other is holding the container or bottle) in a manner such that the ring is released from the radially projecting edge of the neck. Such a ring may be an elliptical ring which can be deformed by exerting pressure on the points situated opposite each other along the longest axis of the ellipse to form a circle with an internal diameter which is larger than the external diameter of the edge. After unlocking, the housing of the sliding valve can then be pulled upwards into the open position.

BRIEF DESCRIPTION OF THE DRAWINGS

The invention will now be explained in more detail with reference to the drawings.

DETAILED DESCRIPTION OF THE INVENTION

Figure 1:
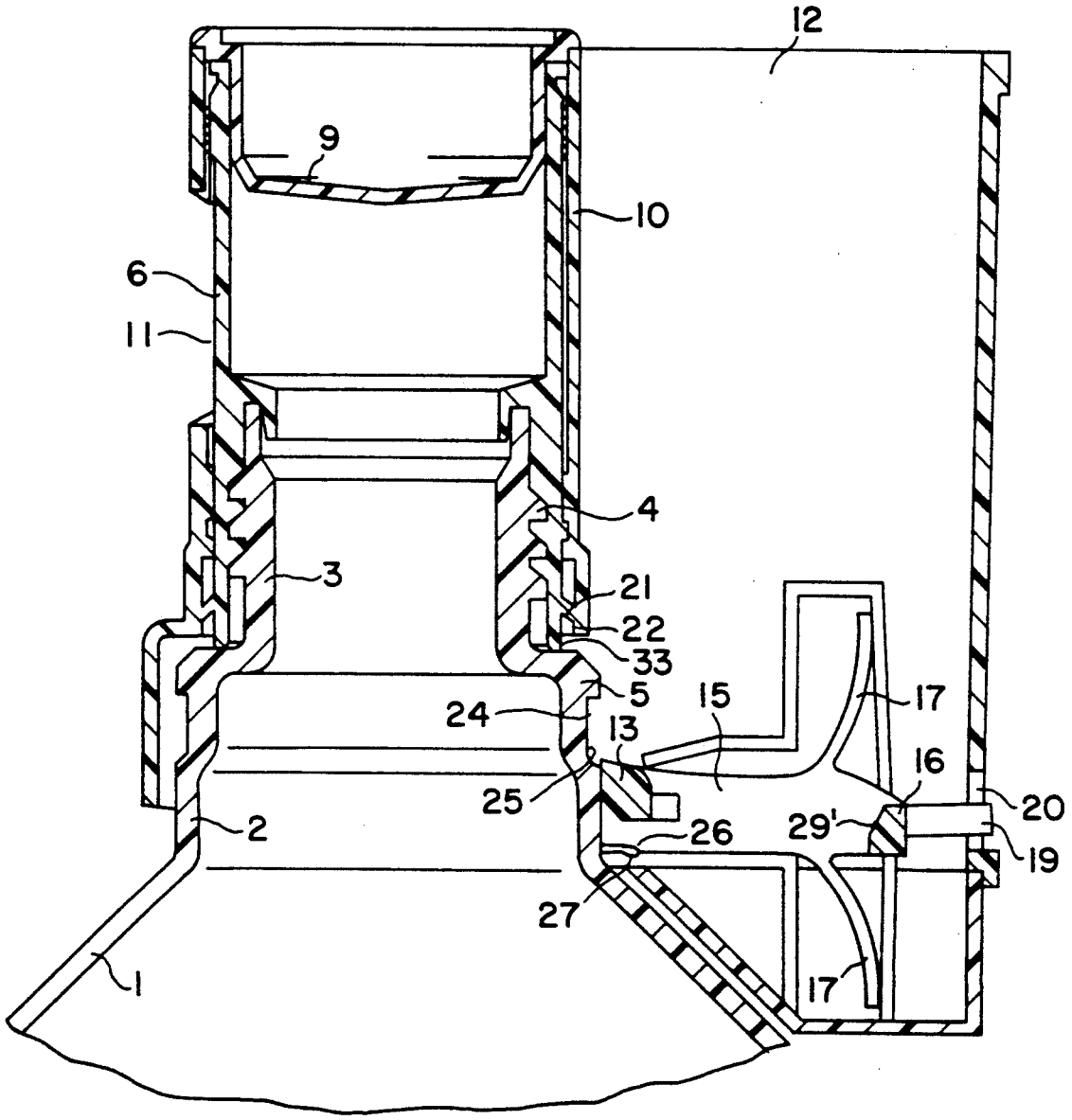
FIG. 1 shows a first embodiment of the child-proof closure according to the invention in section.

The embodiment shown in FIGS. 1 to 4 inclusive comprises a bottle 1 which is provided with a neck 2 having a section 3 which is provided with external screw thread 4. Said neck 3 forms a pouring spout in the usual manner. On the screw thread 4 of the neck 3, there may be a normal screw cap which has an edge which can snap under the projecting edge 5 of the neck 2 and which is joined by means of break strips to the cap. Caps of this type are brought into the locked position automatically when the cap is screwed onto the neck, the break strips being broken off on unscrewing.

In the embodiment shown in FIG. 1 the screw cap, which is no longer shown, has now been replaced by a tubular extension 6 which has an internal screw thread and is placed with the latter on the screw thread 4. Said extension 6 has a pouring opening 7 with a drip edge 8 shown in FIG. 2. In the position shown in FIG. 1, said opening is closed by a cap 9 which is firmly and tightly attached to the housing 10 which is constructed around the tubular extension 6 as a sliding valve with opening 11. If said housing 10 is brought into the open position shown in FIG. 2, the contents of the bottle can then therefore poured out of the extension 7 via the opening 11.

A quiver-like part 12 forms a single entity with the housing 10 which functions as sliding valve and which surrounds the tubular extension by means of the sliding valve section and can be displaced axially along the latter with a sliding fit.

Figure 4:
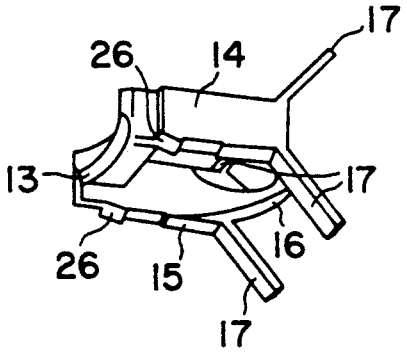
FIG. 4 shows in perspective the locking device associated with the embodiment of FIG. 1.

The quiver-like part 12 is provided, in the lower section, with a lock 13 which forms part of a clasp-like device which is shown in perspective in FIG. 4 and consists of the actual lock 13, two legs 14 and 15 and also an actuating edge 16 and a number of tongues 17 acting as leaf springs. Said tongues 17 rest in box-like recesses 18 provided in the side walls of the quiver-like part 12 of the housing.

Said clasp is further provided with a pin 19 which, in the position shown in FIG. 1, projects through a window 20 of the housing.

FIG. 1 shows the closed position, in particular the position in which the closure is screwed into the absolutely sealed position.

This position is obtained by providing, on the tubular part 6, a helix 21 which interacts with an internal helix 22 of the housing. Said helix 21 may have a stop 23 which serves to prevent the housing being screwed too far during screwing on.

In the child-proof closed position, the lock 13 is situated in the recess 24 which is located below the projecting edge 5. If the helices 21 and 22 are screwed into each other, the housing moves further downwards and the lock 13 runs up against the sloping surface 25 of the neck of the bottle, which results in a transverse displacement of the locking device, as a result of which the pin 19 becomes visible, as shown in FIG. 1, in the window 20.

Said locking device is supported tiltably by the four leaf springs 17. In the normal child-proof locked position in which the lock 13 is situated in the recess 24, the locking device engages by means of locking cam 26 in locking recesses 27 of the supporting surfaces 28 which are provided in the side walls of the quiver-like part. At 29 there is a leaf spring which acts on the legs 14 and 15 of the locking device and presses the latter into the locked position so that the locking device cannot be displaced in the transverse direction.

The actuating section 16 has a bevelled surface 29'. If a finger is inserted into the quiver-like part 12 and the sloping surface 29' is pressed, the locking device will be pressed slightly downwards and consequently tilt, as a result of which the locking cam 26 is released from the locking recess 27 and can then be pushed sideways and released from the recess 24 so that the housing can be moved in its entirety to the position shown in FIG. 2.

Figure 2:
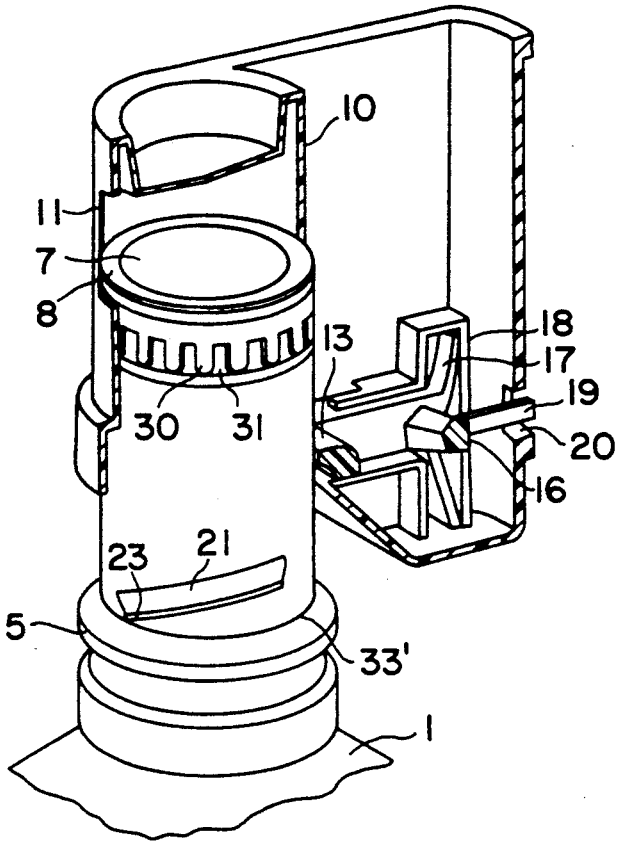
FIG. 2 shows the closure of FIG. 1 in perspective and in the open position of a part of the closure.

FIG. 2 further reveals that the tubular extension has ribs 30 near the top end with recesses 31 situated between them.

Figure 3:
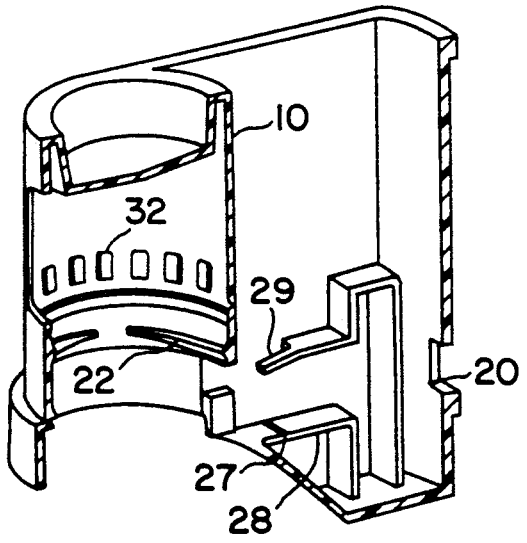
FIG. 3 shows the same part of the closure as shown in FIG. 2 without the extension placed on the bottle.

FIG. 3 shows that the part of the housing acting as sliding valve has ribs 32 on the inside. Said ribs 32 fit into the spaces 31 between the ribs 30. In the open position shown in FIG. 2, the result is achieved by the mutual engagement of the ribs 30 and 32 that the sliding valve cannot rotate. This has the consequence that, during pouring, the housing with the quiver-like part does not swivel into an undesirable position.

In this position shown in FIG. 2, it is also possible to screw off the tubular extension of the neck of the bottle. This does not present a danger for the safety of the child because, in this position, the closure has been opened by an adult and cannot be opened by a child, and the bottle will usually be empty. If a mishap occurs during unscrewing, the closure can still always be closed if the unscrewing is still incomplete and can be brought into the child-proof position by pressing the housing downwards.

As shown in FIGS. 1 and 2, the tubular extension may be provided at the lower edge with teeth or a roughening 33 which acts on the roughened upper surface 33' of the projecting edge 5 and ensures that unscrewing requires some force.

In the embodiment shown in FIGS. 5 to 8 inclusive, the screw cap initially placed on the bottle neck is also removed and replaced by a tubular extension 36 having a lower section 37 which is provided with an internal screw thread and is placed on the external screw thread 4 of the neck of the bottle.

On this tubular extension 36 there is a sliding valve 38 with an outlet opening 39. In this embodiment, the top end 40 of the tubular extension 36 is also provided with a pouring edge 41.

Figure 5:
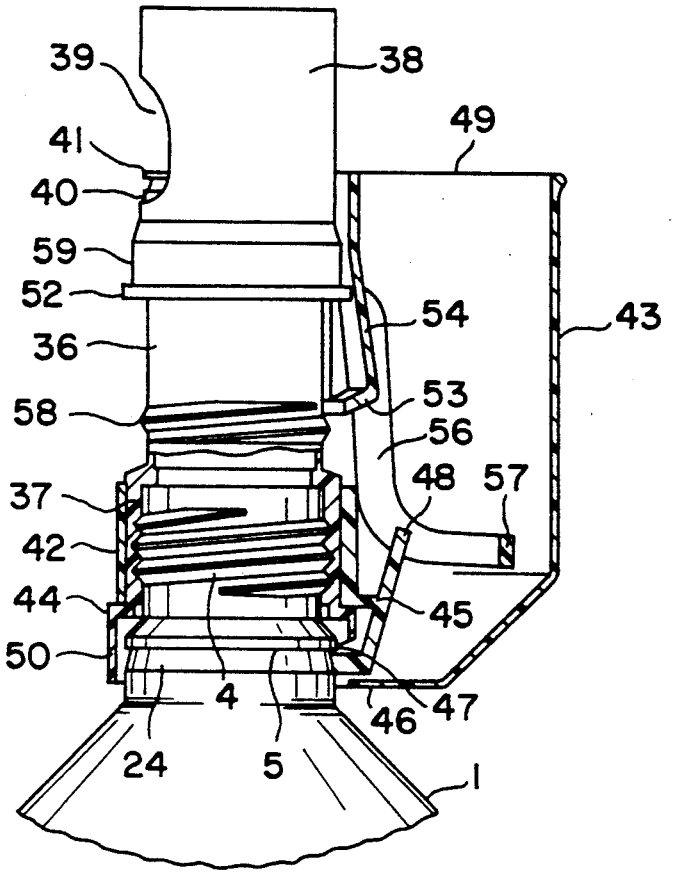
FIG. 5 shows a second embodiment of the child-proof closure according to the invention partly in elevation and partly in section, in particular in the opened position.

FIG. 5 shows the opened position which makes it possible to pour out the contents of the bottle via the top end of the tubular extension and the opening 39.

On the section 37 of the tubular extension, there is a freely rotatable ring 42 which forms a single entity with a quiver-like part 43. Said ring rests in the downward direction on a shoulder 44 of the tubular extension 37, 36 and is constructed with a resiliently mounted or constructed locking pawl 45 which has a lock 46 which engages via an opening 47 in the space 24 below the projecting edge 5. Said lock has an actuating device 48 which is situated at the bottom of the quiver-like part 43 whose access opening 49 offers room for only one finger of an adult's hand. If the lock 45, 46, 48 is actuated, the entire closure can be screwed off provided provisions are made which ensure that the capability of rotation of the ring 42 on the part 37 of the tubular extension can then be immobilized.

A provision which makes this possible is shown in FIG. 5 and consists in the tubular extension having a downwardly directed sleeve 50 with an opening 47 for the lock 46, which sleeve is situated with the opening at a distance from the outside edge of the projecting edge 5 such that it is also possible for the lock to be in contact with the side edge of the opening 47 in the position of the lock in which the latter is swivelled outside of the region of the edge 5. A ring and screw thread section of the tubular extension are then coupled to each other in a manner such that screwing off and tightening up is possible with actuation, obviously simultaneous, of the lock 46 by pressing the finger on the lever 48. Other provisions are, however, conceivable in this connection, such as a pin which could be inserted through holes in ring 42 and part 37 or an embodiment in which the ring 42 is not fitted in a freely rotatable manner on the tubular part or even forms a single entity with it. On tightening up, the locked position will always be reached automatically because the pawl slides over the bevelled upper edge of the edge 5. Screwing off is, however, then not possible because the lock then remains inserted behind the lower edge of the projecting edge.

The sliding valve 38 is provided with a flange 52. In the quiver-like part there is a second resilient lock 53 which is attached to an elastic lip 54 which may form part of the inside wall of the quiver-like part 43. On said elastic lip 54 there is an actuating device 56 with an end 57 to be actuated with the finger. If the sliding valve 38 is pressed downwards, the flange 52 will engage under the lock 53 and be immobilized. The lock 53 is only able to release the sliding valve by moving the actuating end 57 to the right in FIG. 5.

Figure 6:
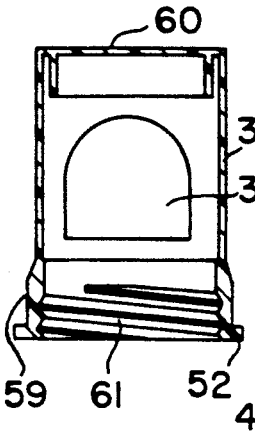
FIG. 6 shows a component of the closure of FIG. 5 in section.
Figure 7:
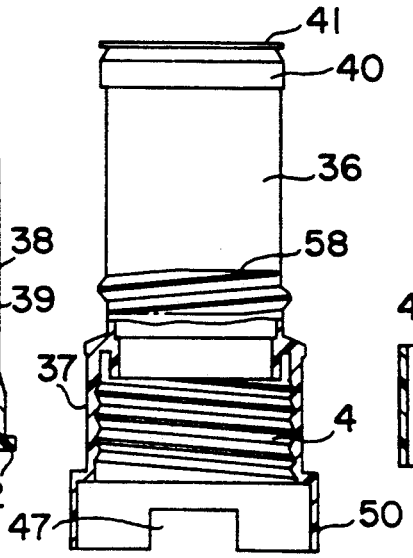
FIG. 7 shows in section a partial elevation of another component of the closure of FIG. 5.
Figure 8:
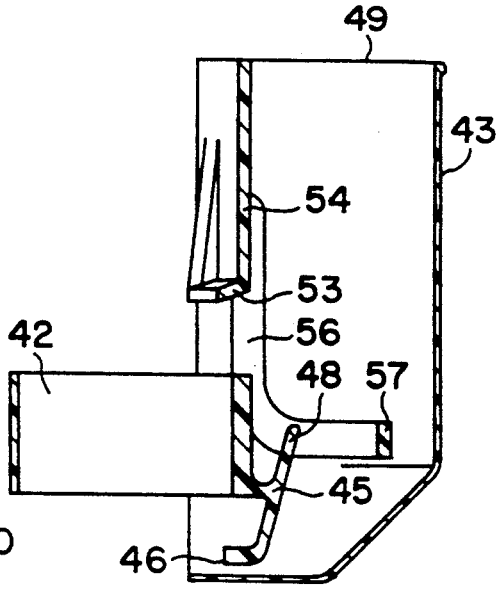
FIG. 8 shows the housing of the closure of the embodiment of FIG. 5 in section.

The tubular extension 36 is provided in this case as well with a helix 58 which interacts with a helix 61 in the lower section 59 of the sliding valve in order to obtain a tight join between the top end 60, shown in FIG. 6, of the sliding valve with the top end 41, which fits therein, of the tubular extension shown in FIG. 7. If the sliding valve is screwed with the screw thread 61 of the part 59 onto the screw thread 58, a seal which is safe for transportation is possible.

Figure 9:
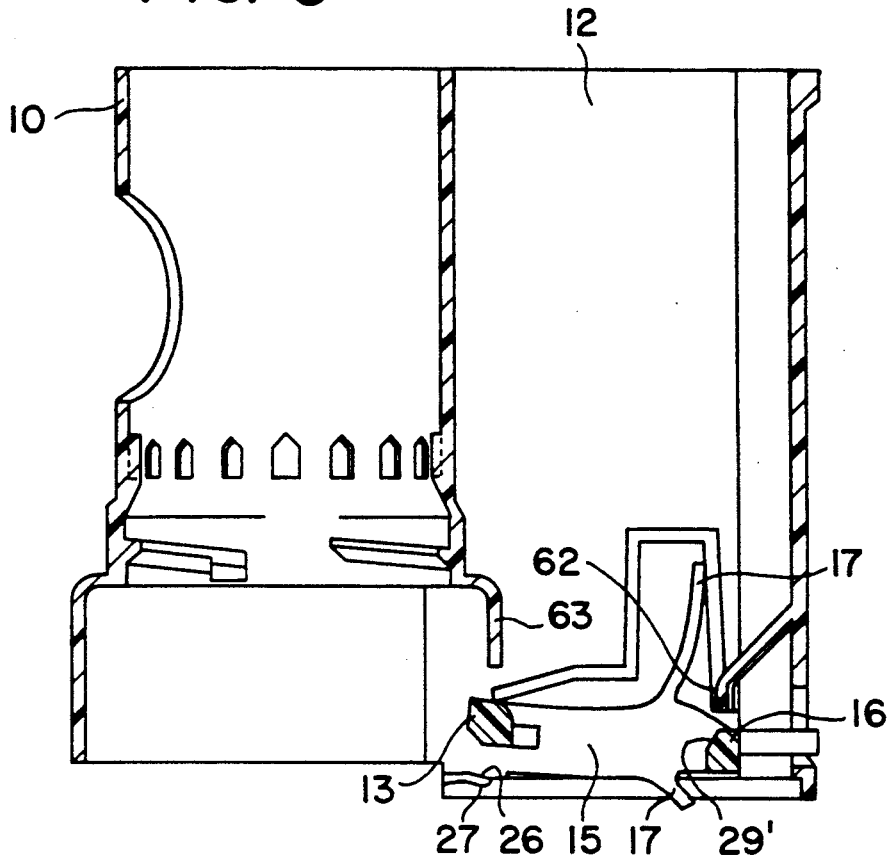
FIG. 9 shows, in section, a sliding valve with "quiver" which, unlike the embodiment shown in FIG. 3, is provided with means which protect the locking device.

FIG. 9 shows a further protection against undesirable actuating attempts in the first embodiment. For this purpose, the quiver-like part 10 is provided with a guard 62 which is situated just above the actuating surface 29' of the clasp 16. Furthermore, the housing is provided, on the inside of the quiver-like part, with an edge 63 whose lower edge projects to just above the locking cam 13 so that the latter is equally inaccessible for a pin-like tool.

Figure 10:
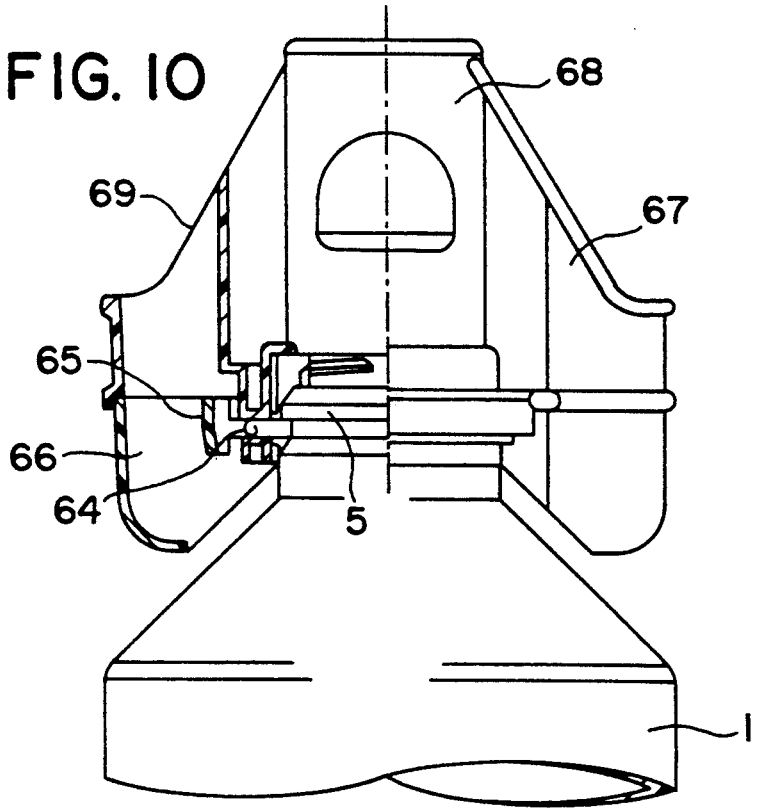
FIG. 10 shows partly in elevation and partly in section a third embodiment of the child-proof closure according to the invention.

FIG. 10 shows a third embodiment having a sliding valve 68 which is placed in an axially displaceable manner on the tubular extension which is screwed onto the neck.

The housing of the sliding valve accommodates a deformable ring 64 which is elliptical in shape and engages, in the unstressed state, under the edge 5 of the neck at two points situated opposite each other.

Said ring 64 has actuating parts 65 at two other points situated opposite each other.

If pressure is exerted on the two parts 65 situated on the longest axis of the ellipse, the ring is pressed into a circular shape, as a result of which unlocking becomes possible. Said parts 65 are situated in shallow quiver-like spaces 66 with access openings 69.

If a sufficiently long finger of a hand is inserted into each opening 69, it is possible to operate the locking ring 64, 65.

The two spaces 66 are situated at such a distance from each other and are directed and shaped in such a manner that only the fingers of a hand having predetermined sizes, such as of an adult, are capable of performing the unlocking.

Figure 11:
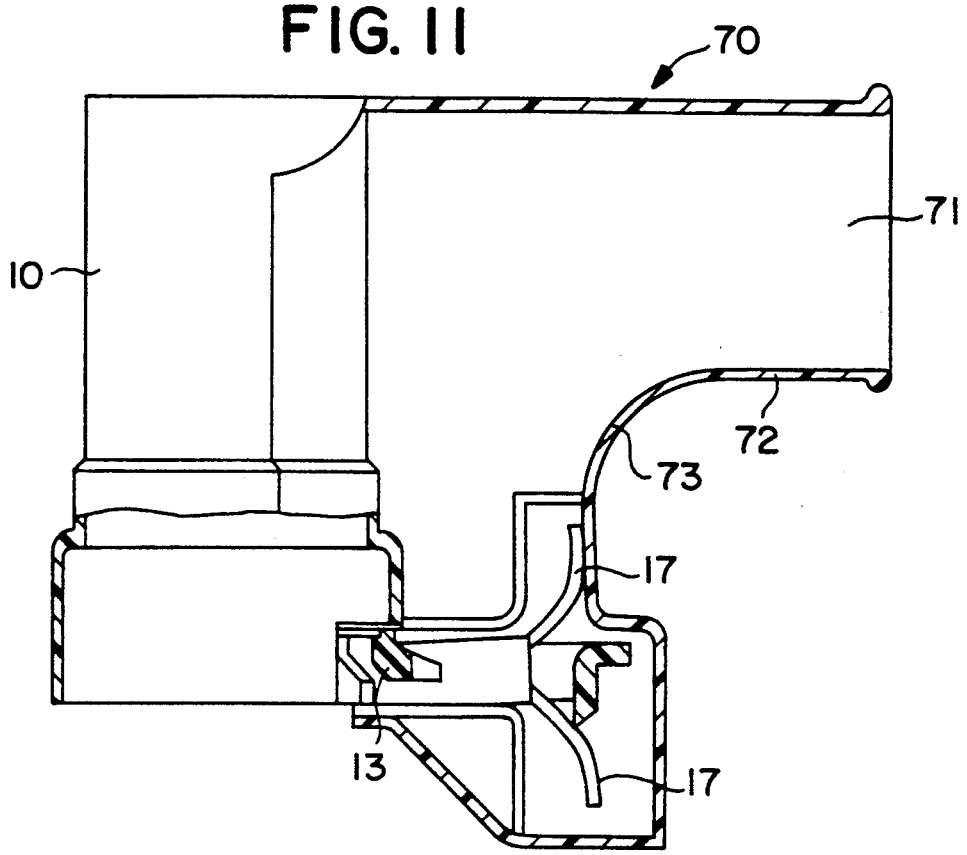
FIG. 11 shows a fourth embodiment of the child-proof closure according to the invention.
Figure 12:
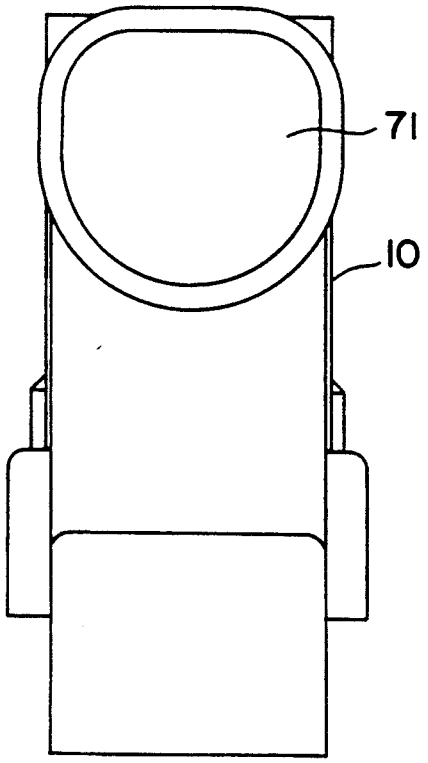
FIG. 12 shows a side elevation of the closure of FIG. 11.

The embodiment according to the FIGS. 11 and 12 differs from that according to one or more of FIGS. 1 to 9 inclusive only in that the quiver-like part 70, which may form a single entity with the housing 10, has an insertion opening 71 for the finger which is situated in a laterally projecting part 72 whose lower wall runs along a curve 73 towards the actuating section 16 of the lock 13 whose shape and function essentially correspond with that of the lock shown in FIGS. 2 and 4.

The upper wall of said quiver-like part is obviously then closed and is situated prefably in one plane with the upper surface of the housing 10.

There are thus also resilient tongues 17.

The cams 26 are, however, absent in this embodiment. They are no longer necessary because the absolute security in relation to undesired actuation and consequently the intended safety for the child is obtained because the section 16 is accessible only for a bent finger of sufficient length.

I claim:

1. In a child-proof closure for a container (1) having a neck (2, 3) having an external joining device (4) for a detachable closure cap, said neck (2, 3) having a radially projecting edge (5) situated beneath the joining device (4) which edge (5) is adapted to contact a ring of a said detachable closure cap, which ring grips under the said edge (5) and is joined to the removable closure cap by means of break strips which break upon a first unscrewing of the closure cap, a resilient locking device (13) which engages the neck (2) below said edge (5) and which has actuating means (16, 29') for operating the locking device, means preventing access to said actuating means by fingers of a child, said locking device being located in a section of the closure which after removal of the detachable closure cap is placed over the neck (2, 3) and locked by said locking device (13), said locking device being unlocked by manipulation of said actuating means (16, 29') by the finger of an adult; the improvement wherein a section of the child-proof closure has an internal screw thread by means of which said section can be placed on a part (3) of the said neck (2) provided with said joining device (4) instead of and only after removal of the detachable closure cap, said section having a tubular extension (6) above said internal screw thread, which extension (6) is in line with the neck (2) and has an outlet opening (7), a sliding valve (10) with a lateral outlet opening (11) mounted axially slidably on said extension (6), said sliding valve (10) closing the outlet opening (7) of the tubular extension (6) in a pushed-in closed position in which the sliding valve (10) is locked by the said locking device (13) under the said radially extending edge (5) of the neck (2), said sliding valve (10) after being unlocked by retracting said locking device (13) from below said radially extending edge (5) by said actuating means ()16, 29'), being adapted to be pushed upwardly into a position in which the outlet opening (7) of the tubular extension communicates with the lateral outlet opening (11) of the sliding valve (10).

* * * * *